US006643377B1

(12) United States Patent
Takahashi et al.

(10) Patent No.: US 6,643,377 B1
(45) Date of Patent: Nov. 4, 2003

(54) AUDIO OUTPUT SYSTEM AND METHOD THEREFOR

(75) Inventors: Naoto Takahashi, Urawa (JP); Hirohiko Katayama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/296,561

(22) Filed: Apr. 22, 1999

(30) Foreign Application Priority Data

Apr. 28, 1998 (JP) ..... 10-132569
Dec. 25, 1998 (JP) ..... 10-376501

(51) Int. Cl.[7] ..... H04R 25/00

(52) U.S. Cl. ..... 381/306; 381/333; 381/160; 381/303; 181/155

(58) Field of Search ..... 381/61, 86, 87, 381/160, 300, 303, 306, 333; 101/155

(56) References Cited

U.S. PATENT DOCUMENTS 5,210,802 A * 5/1993 Aylward ..... 381/61
5,321,760 A * 6/1994 Gray ..... 381/86
5,885,129 A * 3/1999 Norris ..... 446/405
6,215,883 B1 * 4/2001 Leonarz ..... 381/182

* cited by examiner

*Primary Examiner*—Curtis Kuntz
*Assistant Examiner*—Tuan Duc Nguyen
(74) *Attorney, Agent, or Firm*—Fitzpatrick, Cella, Harper & Scinto

(57) ABSTRACT

There is provided an audio output apparatus capable of providing an effect, with a limited number of speakers, as if the person displayed on the display screen is really speaking. When the television conference is started with a communication partner through a set top box, the image of the communication partner is displayed on the image displaying reflective plate. At the same time, ultrasonic waves superposed with the voice of the partner are emitted from a left speaker and a right speaker. The sound emitting directions of the left and right speakers are directed toward the image displaying reflective plate on which the partner is displayed. The ultrasonic waves emitted from the left and right speakers are reflected by the reflective plate and proceed toward the listener who can hear the voice of the partner as if the voice is directly emitted from the reflective plate.

15 Claims, 9 Drawing Sheets

AUDIO OUTPUT SYSTEM AND METHOD THEREFOR

BACKGROUND OF THE INVENTION

Field of the Invention

The present invention relates to an audio output system utilizing a speaker and adapted to transmit audio relating to an image displayed on a screen toward a direction opposed thereto, and a method therefor.

There are currently commercialized several speaker systems capable of reproducing realistic sound. Among these, there is known a surround system utilizing the DVD (digital video disk) as the sound source and the image source. Such DVD system, utilizing the digital Dolby recording, can realize realistic sound by executing the reproduction by the digital Dolby system.

This system however requires five speakers, namely under the image display, behind the listener, for very low sound, left and right.

On the other hand, in a television (TV) conference system employing personal computers and television sets, while the image of a speaking person is displayed on the screen 101*a* as shown in FIG. 9, the voice of such person is normally outputted from speakers 102*a*, 103*a* positioned on both lateral sides of the screen. FIG. 9 is a plan view of a conventional TV conference system.

Also in case the voice of the speaking person has to be heard only by the listener 104*a* or in case the sound output is molesting to other persons, the sound has to be heard with the headphones or earphones.

On the other hand, there are recently increasing occasions of presentations of new business plans or the like with personal computers. In such occasion, a larger screen is preferred in order to give a strong impression to the viewers.

Also in case of viewing television or video at home, a larger screen is preferred for increasing the impact or the feeling of reality.

Furthermore, it is quite common to display the image video of a company or the commercial film of new products on a large screen at various exhibitions or shows in order to advertise the value of such company or products. Such larger screen used at the exhibitions or shows is often constituted by combining several large-sized television sets. Also a plasma display or a rear projector is increasingly used for this purpose.

In such case it is important to design the sound effect in combination with the image displayed in the screen, because the effect of the image can become good or bad, depending on the sound effect.

Usually well known is the stereo sound effect utilizing speakers positioned at left and right of the large screen. Also there is employed the surround sound effect for increasing the appeal to the listener by providing sound from the front, rear and lateral sides.

However the sound reproduction by the aforementioned digital Dolby system not only involves a higher cost for the necessary equipment but also a large space for installing the speakers.

Also in the TV conference system explained before, the voice of the speaking person, released from the speakers at right and left of the screen, does not sound as if spoken by the person displayed on the screen, thus lacking the feeling of reality.

Also as a drawback common to the foregoing two systems, the output sound can be heard by a person irrelevant from such sound and may give unpleasant feeling thereto.

On the other hand, in order to shield irrelevant persons from the output sound, it is necessary to use headphones or the like, so that the convenience of use becomes deteriorated.

Furthermore, there are required considerable spaces in order to place the speakers at right and left of the screen. Also, in order to realize the surround sound effect, it is necessary to install the speaker behind the listener in addition to the front side. Consequently there is required an even larger space, and the number of the listeners is inevitably limited, rather contrary to the objective to give presentation to as many persons as possible. Furthermore, the installation of the speakers requires complex wirings, involving a larger amount of work and possibility of erroneous wirings.

SUMMARY OF THE INVENTION

In consideration of the foregoing, an object of the present invention is to provide an improved audio output apparatus or system capable of solving all or at least one of the aforementioned drawbacks.

Another object of the present invention is to provide a novel audio output method utilizing such apparatus, system or method.

Still another object of the present invention is to provide audio output apparatus, system and method capable of realizing, with a limited number of speakers, a real effect as if the speaking person displayed on the screen is really speaking.

Still another object of the present invention is to provide audio output apparatus, system and method capable of rendering the sound outputted from the speaker less audible to the irrelevant persons thereby making the sound less annoying thereto.

Still another object of the present invention is to provide audio output apparatus, system and method allowing the listener to experience the surround sound effect by a highly directional speaker mounted on a projector used for projecting the image.

The above-mentioned objects can be attained, according to an embodiment of the present invention, by an audio output apparatus for transmitting the sound, relating to the image displayed on the screen, toward a side opposed thereto, the system comprising an image display unit having a screen for displaying the image, a reflective member provided on the screen of the image display unit and adapted to reflect the sound wave, and a speaker for generating a sound wave corresponding to the sound, wherein the speaker is so positioned that the sound wave generated by the speaker is reflected by the reflective member and is emitted toward the side opposed to the screen of the image display unit.

Still other objects of the present invention, and the features thereof, will become fully apparent from the following description of the embodiments, to be taken in conjunction with the attached drawings.

DESCRIPTION OF THE PREFERRED EMBODIMENTS

The audio output apparatus, system and method of the present invention will be clarified in detail by embodiments thereof.

First Embodiment

Figure 1:
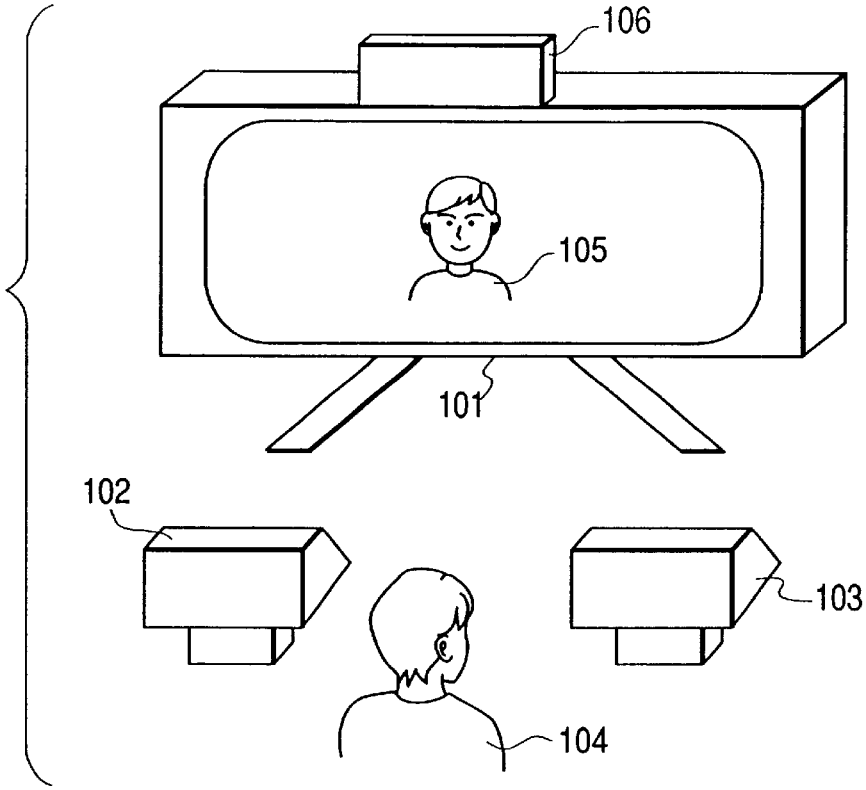
FIG. 1 is a view showing the configuration of a TV conference system constituting a first embodiment.

The audio output apparatus of the present embodiment is applicable to a TV conference system. FIG. 1 shows the configuration of the TV conference system of the first embodiment, wherein an image displaying reflective plate 101 is capable of displaying an image and is provided with a reflective plate for reflecting the sound wave. The reflective plate is composed of a material of low sound wave absorption, such as glass or plastics. Such image displaying plate with such reflective plate is composed, in the present embodiment, of a plasma display.

An ultrasonic speaker 102 (hereinafter called left speaker), emitting highly directional ultrasonic wave, is positioned at the left-hand side of the listener 104, and an ultrasonic speaker 103 (hereinafter called right speaker), emitting highly directional ultrasonic wave, is positioned at the right-hand side of the listener 104. These speakers emit an ultrasonic wave, for example, including a carrier wave of 200 kHz and an audio wave of 0 to 20 kHz superposed therewith.

There are also shown a communication partner (speaking person) 105 displayed on the image displaying reflective plate 101, and a set top box 106 of the TV conference system.

In the following there will be explained the principle, in a TV conference utilizing the system of the above-described configuration, how the sound is felt as if it is directly emitted from the displayed communication partner (speaking person).

When the TV conference is started with the communication partner through the set top box 106, the image of the communication partner is displayed on the image displaying reflective plate 101. At the same time, the voice of the communication partner is outputted from the left speaker 102 and the right speaker 103. In this state, the sound source outputs of the left and right speakers 102, 103 are directed toward the image displaying reflective plate 101, on which the image of the communication partner 105 is displayed.

Figure 2:
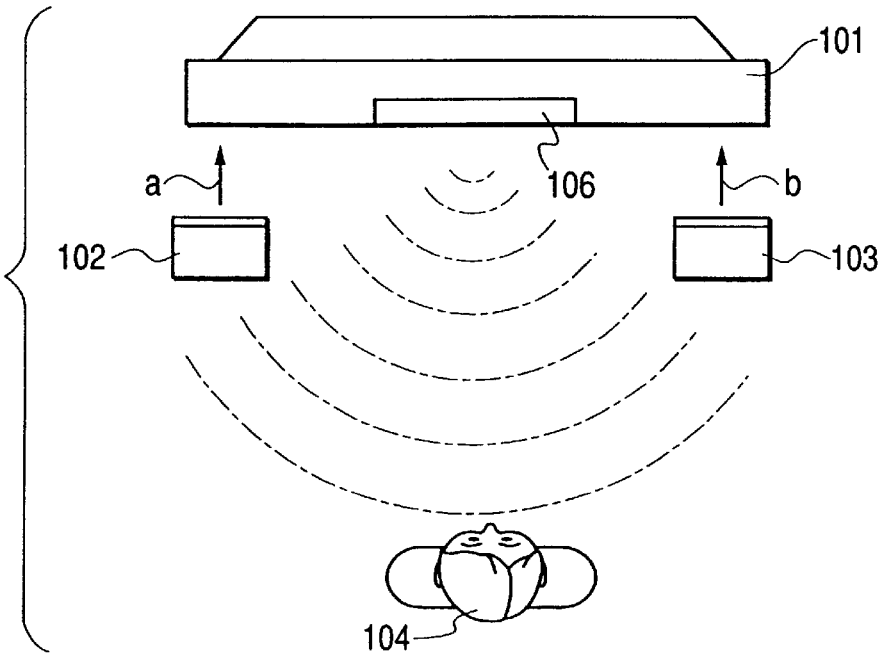
FIG. 2 is a view showing the sound source output direction of the left and right speakers in the TV conference system.

FIG. 2 shows the sound source output directions of the left and right speakers in the TV conference system. The highly directional ultrasonic waves emitted by the left speaker 102 and the right speaker 103 respectively in directions a, b are converted, upon reflection by the image displaying reflective plate 101, into non-directional ultrasonic waves and reach the listener 104.

Consequently the listener 104 can hear the voice of the communication partner 105 as if it is directly outputted from the image displaying reflective plate 101. It is therefore possible to provide an impression, with a minimum number of speakers, as if the person displayed on the screen is actually speaking.

Second Embodiment

Figure 3A:
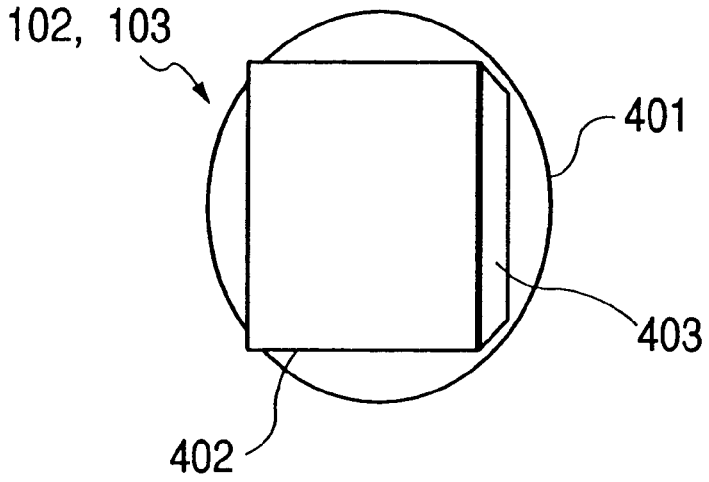
FIGS. 3A and 3B are views showing a state of the left and right speakers prior to rotation.
Figure 3B:
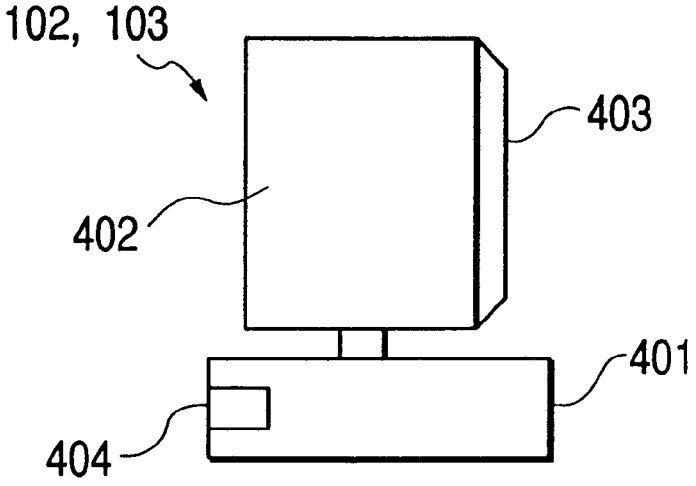
Figure 4A:
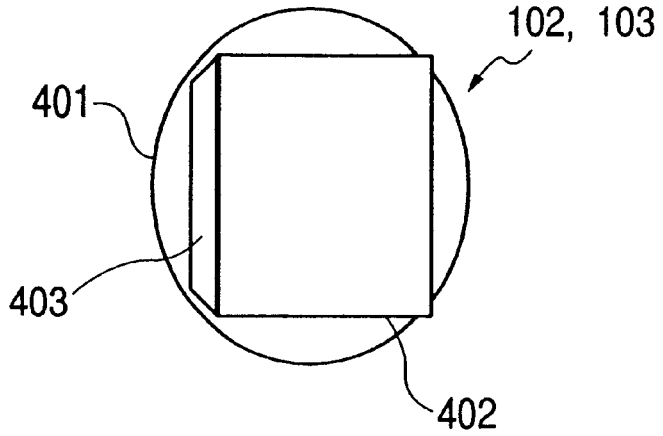
FIGS. 4A and 4B are views showing a state of the left and right speakers after rotation.
Figure 4B:
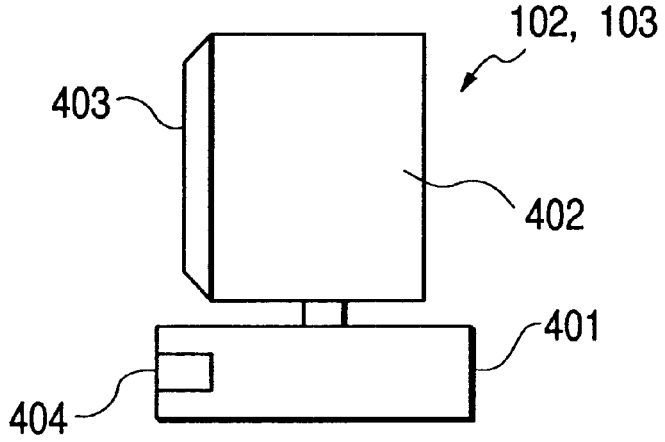

In the following there will be explained a TV conference system constituting a second embodiment. FIGS. 3A and 3B are respectively a plan view and a lateral view, showing left and right speakers in a state prior to rotation, while FIGS. 4A and 4B are respectively a plan view and a lateral view, showing the left and right speakers in a state after rotation. In these drawings, components same as those in the first embodiment are represented by same numbers and will not be explained further. Also in the second embodiment, the left speaker 102 and the right speaker 103 are composed of ultrasonic speakers emitting highly directional ultrasonic waves as in the first embodiment.

Referring to these drawings, there are shown a base member 401 for rotatably supporting each speaker 402, a protective net 403 for protecting the sound output face of the speaker, and a photosensor unit 404 for receiving a rotation command for rotating the speaker 402 supported by the base member 401.

Figure 5:
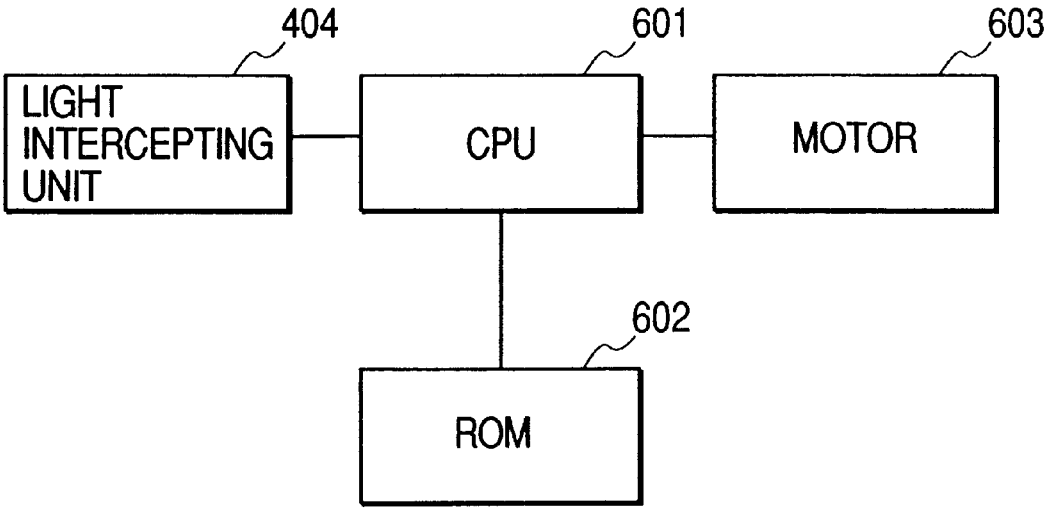
FIG. 5 is a block diagram showing the configuration of a control unit for respectively controlling the rotation of the left speaker 102 and the right speaker 103.

FIG. 5 is a block diagram showing the configuration of a control unit for controlling the individual rotation of the left speaker 102 and the right speaker 103. The control unit is housed in the base member 401 and is provided with a central processing unit (CPU) 601, a ROM 602 storing a control program, and a motor 603 for rotating the base member 401.

Figure 6:
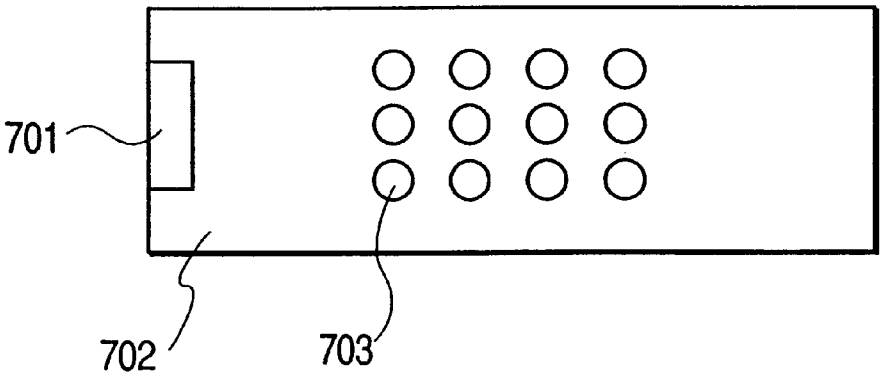
FIG. 6 is an external view of a commander for transmitting a rotation command for rotating the left speaker 102 and the right speaker 103 by an operation of the listener 104.

FIG. 6 is an external view of a commander for transmitting a rotation command for rotating the left speaker 102 and the right speaker 103, by the operation of the listener 104. There are shown a light emitting unit 701 for transmitting an optical rotation command for rotating the speaker 402 supported on the base member 401, a main body 702 of the commander, and push-button switches 703 to be used for rotating the speakers.

In the following there will be explained, in a TV conference utilizing the system of the above-described configuration, the operation in case the listener 104 does not wish the voice of the communication partner 105 to be heard by any other person. At first, as in the first embodiment, the TV conference is started with the communication partner 105 through the set top box 106. In this state, the listener 104 depresses a push-button switch 703 of the main body 702 of the commander.

In response to the depression of the push-button switch 703, the light emitting unit 701 of the commander transmits a rotation command to the photosensor unit 404 provided in the base member 401.

The rotation command for rotating the speaker 402 supported by the base member 401, received by the photosensor unit 402, is transmitted to the CPU 601.

Figure 7:
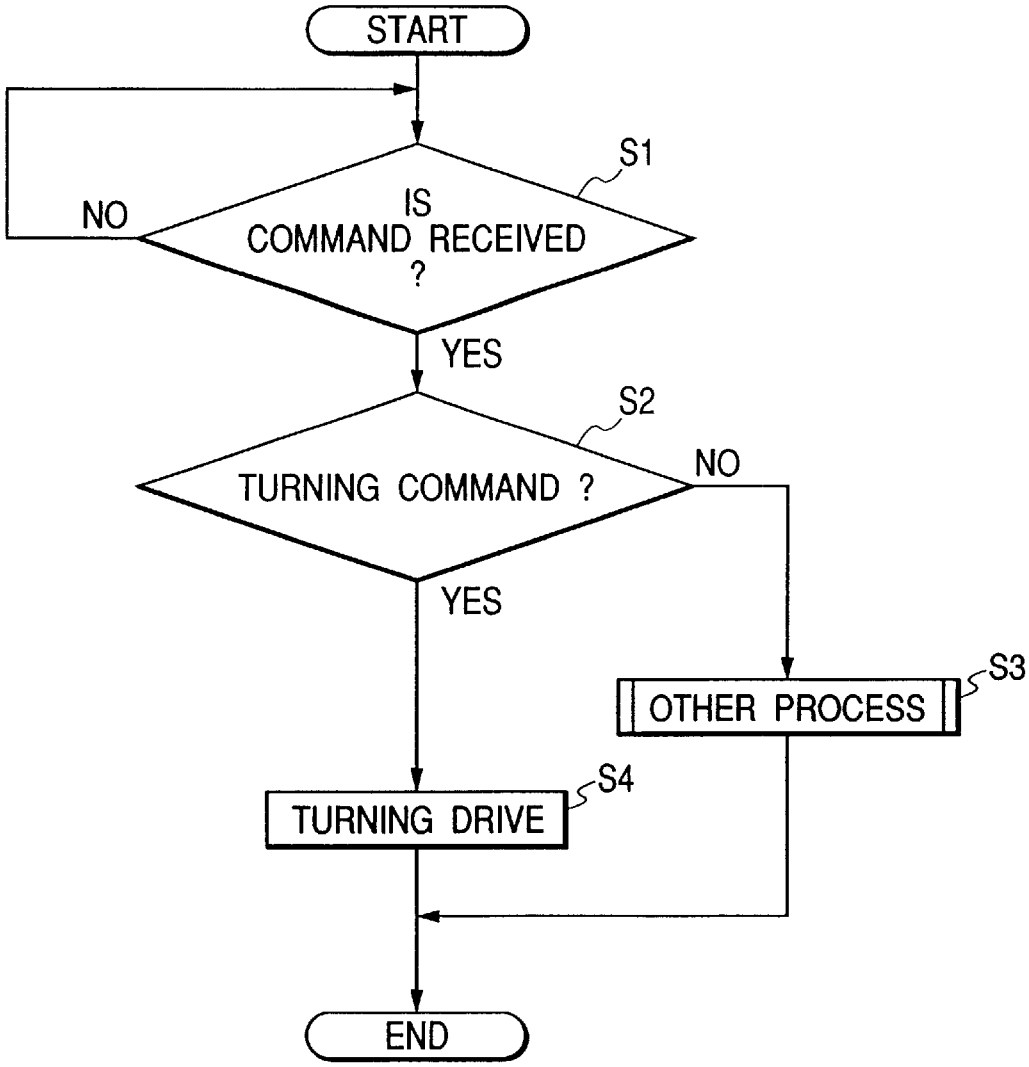
FIG. 7 is a flow chart showing the control sequence of a control program stored in a ROM 602 and executed by a CPU 601.

The CPU 601 controls the rotation of the speakers according to a control program stored in advance in the ROM 602. FIG. 7 is a flow chart showing the control sequence of the control program stored in the ROM 602 and executed by the CPU 601. At first the CPU waits until a command is received from the photosensor unit 401 (step S1), and, upon receiving the command, discriminates whether it is a rotation command (step S2).

If it is not a rotation command, there is executed another process according to the command (step S3) and the sequence is terminated. On the other hand, if the received command is a rotation command for rotating the speaker 402, the motor 603 is activated to rotate the speaker 402 supported by the base member 401 (step S4), whereupon the sequence is terminated.

Thus the main bodies 402 of the left and right speakers 102, 103 respectively supported by the base members 401 rotate by 180°, whereby the front faces (having the protective net 403) of the speakers 402 are directed toward the listener 104.

Figure 8:
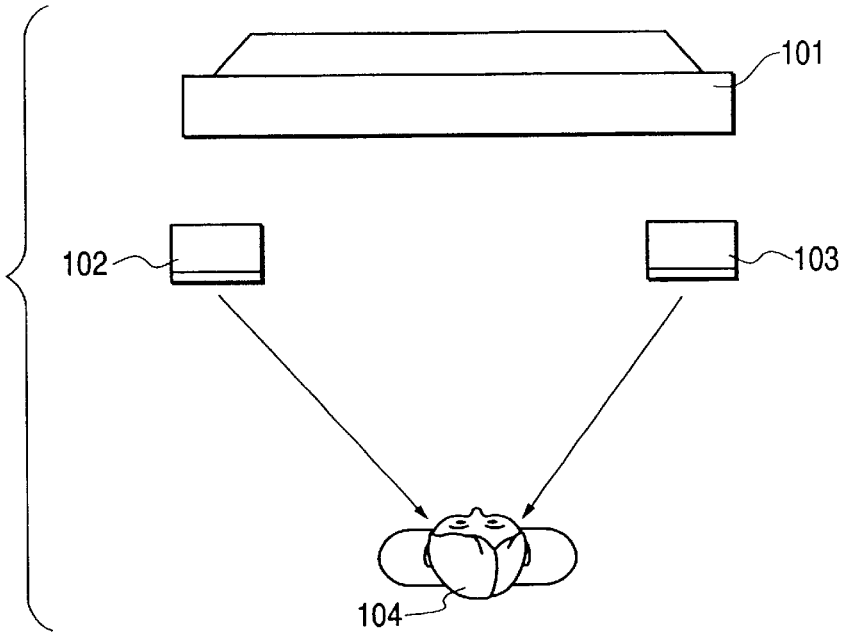
FIG. 8 is a view showing a state in which the left speaker 102 and the right speaker 103 are rotated toward the listener 104.
Figure 9:
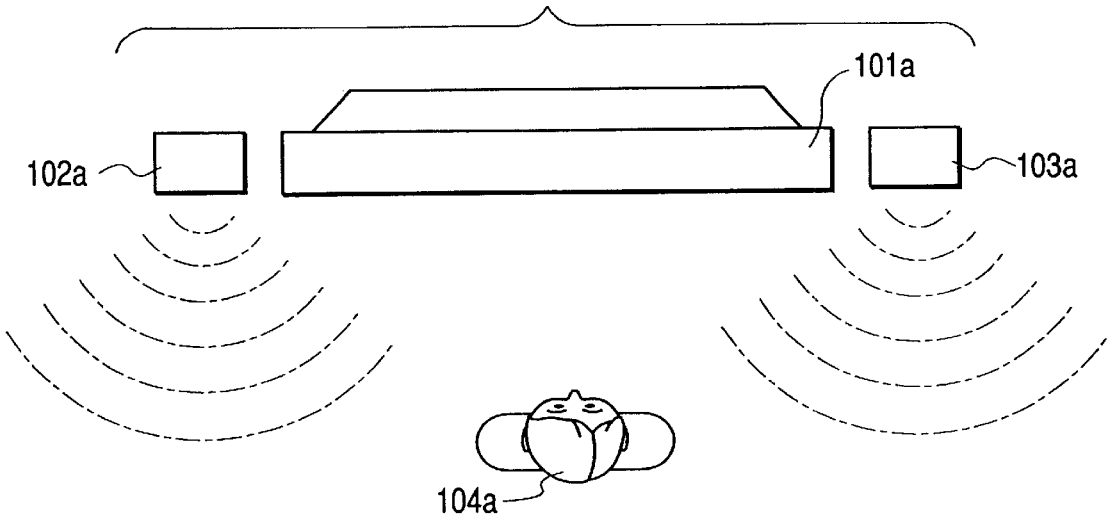
FIG. 9 is a plan view of a conventional TV conference system.

FIG. 8 shows a state in which the left speaker 102 and the right speaker 103 are rotated to face the listener 104. As the ultrasonic wave from the left and right speakers 102, 103 are highly directional, such ultrasonic wave, on which the voice of the communication partner 105 displayed on the image displaying reflective plate 101 is superposed, can reach the listener 104 only and any other person cannot hear such voice.

As explained in the foregoing, when the output directions of the left speaker 102 and the right speaker 103 are toward the image displaying reflective plate 101 (cf. FIG. 2), the ultrasonic waves emitted from these speakers and superposed with the voice of the communication partner 105 are reflected by the image displaying reflective plate 101 and propagate toward the listener 104 whereby the listener 104 can hear the voice of the communication partner 105 as if the voice is directly emitted from the image displaying reflective plate 101. On the other hand, when the output directions of the left speaker 102 and the right speaker 103 are toward the listener 104 (cf. FIG. 8), the ultrasonic wave superposed with the voice of the communication partner 105 displayed on the image displaying reflective plate 101 can only reach the listener 104 but cannot be heard by any other person.

In the present embodiment, the command is transmitted between the commander and the base member by means of light, but there may also be employed wireless transmission or transmission through a cable.

Also, the foregoing embodiments employ a plasma display as the image displaying reflective plate for the TV conference, but such reflective plate may be composed of an electronic blackboard or a picture plane for purposes other than the TV conference.

Also the foregoing embodiments have been explained by a configuration employing ultrasonic speakers capable of emitting highly directional ultrasonic wave, but such configuration is not restrictive and similar effects can be obtained also with other highly directional speakers.

Furthermore, in case the reflective plate is composed of an opaque material such as a metal plate, such opaque material may be provided only in a part of the image displaying reflective plate where the ultrasonic waves from the speakers are reflected.

Furthermore, the foregoing embodiments employ an image displaying reflective plate of which screen serves also as the reflective plate, such as the plasma display, but such configuration is not restrictive and a separate transparent reflective plate may be provided on the screen to constitute the image displaying reflective plate.

Third Embodiment

Figure 10A:
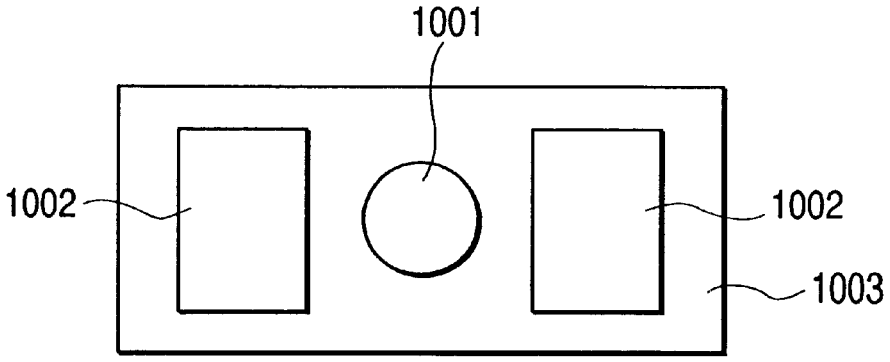
FIGS. 10A and 10B are external views of a projector.
Figure 10B:
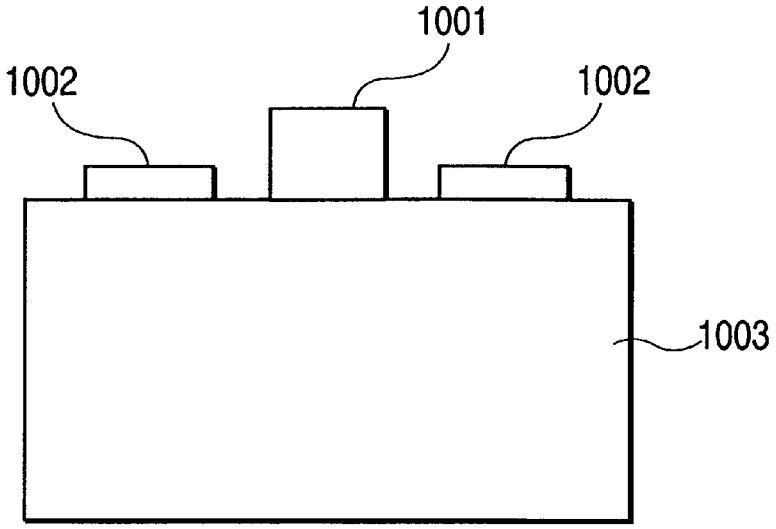

A third embodiment employs a projector (image projecting apparatus). FIGS. 10A and 10B are respectively an elevation view and a plan view of the main body of the projector wherein shown are an image output unit 1101 for projecting an image, and ultrasonic speakers 1002 emitting highly directional ultrasonic waves. The ultrasonic speakers emit highly directional ultrasonic waves as in the first embodiment. 1003 indicates the main body of the projector.

Figure 11:
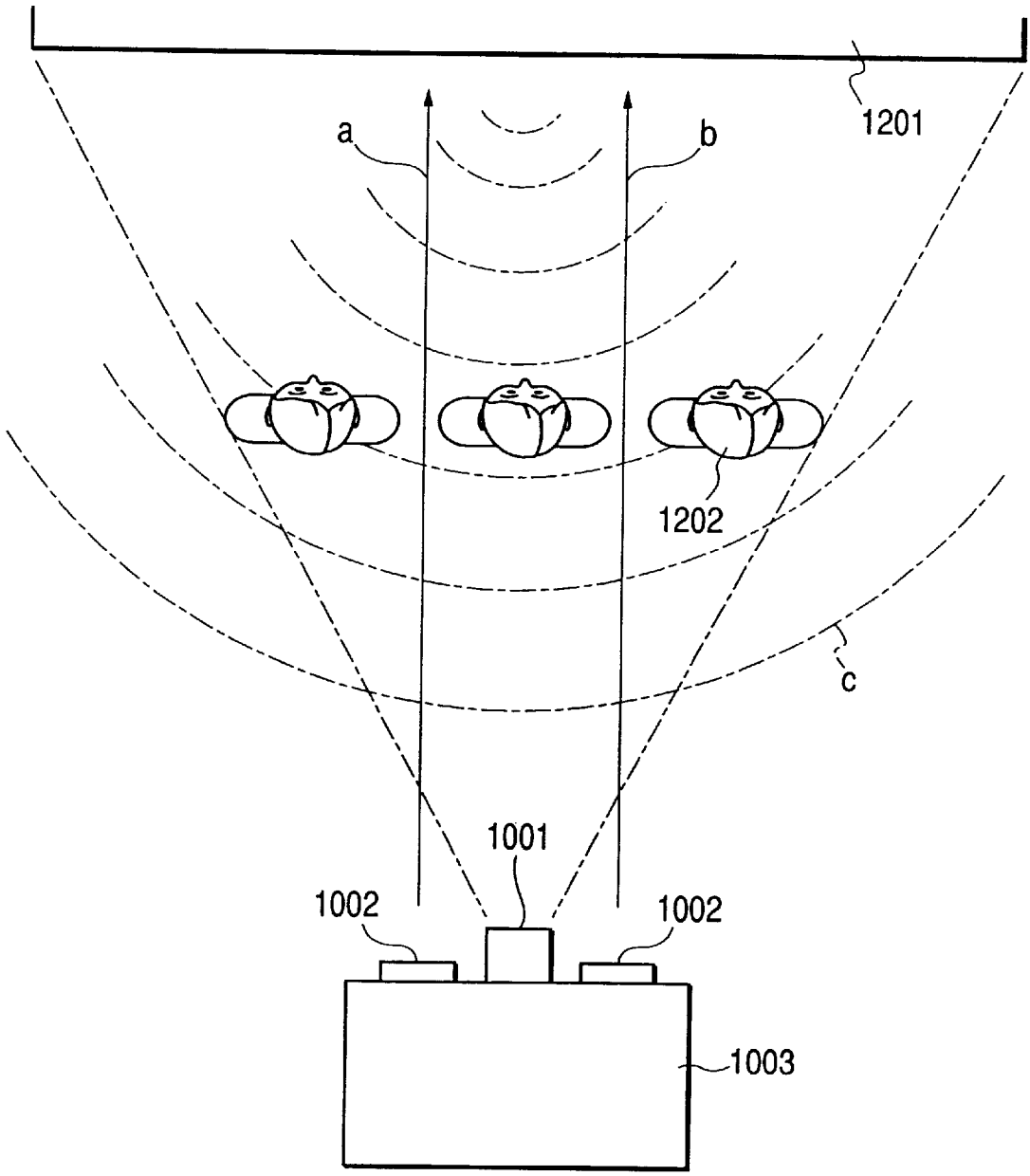
FIG. 11 is a view showing a state of listening with the projector positioned behind the listener.
Figure 12:
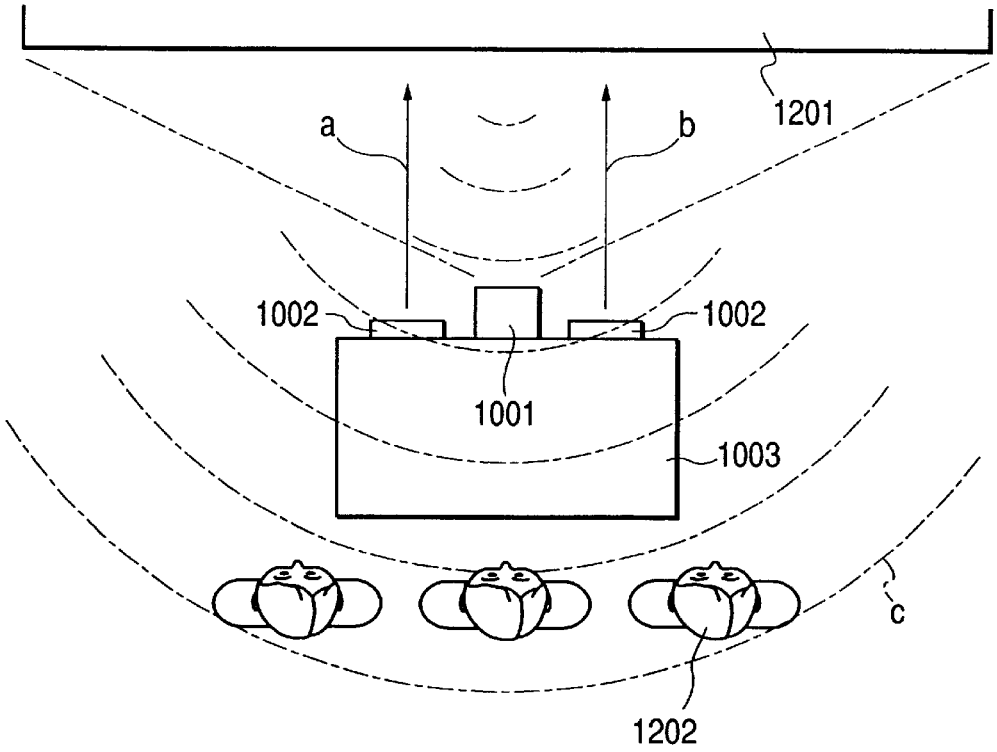
FIG. 12 is a view showing a state of listening with the projector positioned in front of the listener.

FIG. 11 shows a state in which the projector is positioned behind the listener, wherein 1201 indicates a screen for displaying an image projected from the projector. The screen 1201 is composed of a material of low sonic wave absorption, such as a white board composed of plastics. FIG. 12 shows a state of listening with the projector positioned in front of the listener.

In the following there will be explained the principle, in case of observing and listening to the image and sound from the projector, of giving an impression as if the sound is directly outputted from the screen used for displaying the image. The image output unit 1001 of the projector main body 1003 projects an image desired by the listener on the screen 1201. At the same time, the ultrasonic speakers 1002 emit sonic waves superposed with a sound synchronized with the projected image. In this state, the output directions of the ultrasonic speakers 1002 are toward the screen 1201, which is composed of low sonic wave absorption.

In case the project or is positioned behind the listener as shown in FIG. 11, the highly directional ultrasonic waves emitted in directions a, b are reflected by the screen 1201 and are converted, upon reflection, into non-directional ultrasonic waves, which proceed toward the listener 1202 as a spreading voice (c in FIG. 11). Therefore the listener can hear the sound, synchronized with the displayed image, as if the sound is directly outputted from the screen 1201. Such positioning of the projector is suitable for projection onto a large screen to be viewed by a large number of persons.

On the other hand, the projector positioned in front of the listener (cf. FIG. 12) is suitable for projection on a small screen. It is thus rendered possible to give an impression as if the sound is emitted from the screen itself, without suffering from the position of the projector.

The audio output apparatus of the foregoing embodiments, adapted to emit the sound, relating to the image displayed on a screen, toward a side opposed to the screen, is provided with an image display unit having a screen for displaying the image, a reflective member provided on the screen of the image display unit and adapted to reflect the sound wave, and a speaker for emitting a sound wave corresponding to the above-mentioned sound, wherein the speaker is provided in such a position that the sonic wave generated therefrom is reflected by the reflective member and is emitted to a side opposed to the screen of the image display unit. Therefore, it is rendered possible to provide an effect with a limited number of speakers as if the speaking person displayed on the screen is really speaking, and, in case the apparatus of the embodiment is applied to a television conference system, there can be realized an effect as if the voice of the communication partner can be heard as if the person displayed on the screen is actually speaking.

Also the above-mentioned reflective member converts the directional sonic wave generated from the speaker into non-directional sonic wave. Therefore, in case the present invention is applied for example to a television conference system, by generating the sonic wave from the speaker toward the screen on which the image of the communication partner is displayed, the user of the system can hear the sonic wave from the speaker in a natural way by merely be present in an appropriate position opposed to the screen.

Also there is provided switching means for selectively switching the direction of generation of the sonic wave from the speaker either in a direction from the screen of the image display unit to a side opposed thereto or in an opposite direction. Therefore, in case the present invention is applied for example to a television conference system, the direction of the speaker can be switched, when necessitated, from the direction toward the screen to the direction toward the listener whereby the voice of the speaker displayed on the screen can only be heard by a required person only, and the sound generated from the speaker can be made less audible to irrelevant persons, thereby being less annoying to such persons.

Furthermore, the above-mentioned switching means is composed of means for rotating the speaker, so that the speaker can be shifted to any direction for example by a motor.

Furthermore, the above-mentioned speaker is provided in a pair on both lateral sides of the screen of the image display unit, so that sonic waves generated from the speakers with stereo effect can be heard in normal manner.

Furthermore, the above-mentioned speaker mounted on the projector for projecting the image emits the sonic wave toward the screen displaying such projected image, so that the listener can easily experience the surrounded sound effect. Also a similar effect can be obtained in the audio output method according to claim 13.

What is claimed is:

1. An audio output system comprising:

an image display unit having a screen for displaying an image;

a reflective member provided on the screen of said image display unit and adapted to reflect sound waves; and a plurality of speakers, each speaker generating an ultrasonic sound wave corresponding to an audio signal and said audio signal synchronized with said image;

wherein said speakers are capable of selectively turning between a first position where the sound wave generated by the respective speaker is reflected by said reflective member and is transmitted to a listener at a position opposed to the screen of said image display unit, and a second position where the sound wave generated by the respective speaker is output directly toward the listener.

2. An audio output system according to claim 1, wherein said reflective member is adapted to convert a directional sound wave, generated by a speaker, into non-directional sound wave.

3. An audio output system according to claim 1, further comprising switching means for selectively switching the direction of generation of the sound wave from a speaker either in a direction from the screen of said image display unit toward a side opposed thereto or in an opposite direction.

4. An audio output system according to claim 3, wherein said switching means is means for rotating a speaker.

5. An audio output system according to claim 1, wherein said plurality of speakers are provided in a pair, at left and right sides of the screen of said image display unit.

6. An audio output system according to claim 1, wherein said speakers are adapted to generate a directional sound wave including a carrier wave of 200 kHz superposed with audio of 0 to 20 kHz.

7. An audio output method comprising the steps of:

utilizing an image display unit provided with a reflective member, for reflecting an ultrasonic sound wave, on a screen for displaying an image;

selectively turning a plurality of speakers between a first position for reflecting the ultrasonic sound waves corresponding to audio signals generated from the plurality of speakers using said reflective member and transmitting said sound waves to a listener at a side opposed to the screen of said image display unit, and a second position for transmitting the sound waves from the plurality of speakers directly to the listener, wherein the audio signals are synchronized with said image.

8. An audio output method according to claim 7, wherein said reflective member is adapted to convert a directional sound wave, generated by a speaker, into non-directional sound wave.

9. An audio output method according to claim 7, wherein the direction of generation of the sound wave from a speaker is selectively switchable in a direction from the screen of said image display unit toward a side opposed thereto or in an opposite direction.

10. An audio output method according to claim 7, wherein said speakers are provided in a pair, at left and right sides of the screen of said image display unit.

11. An audio output method according to claim 7, wherein each speaker is adapted to transmit a directional sound wave including a carrier wave of 200 kHz superposed with audio of 0 to 20 kHz.

12. An audio output apparatus according to claim 1, wherein said image display unit is composed of a projector for projecting an image and a screen for displaying said projected image, and said plurality of speakers are mounted on said projector and is adapted to transmit the sound wave toward said screen.

13. An audio output method according to claim 7, wherein said plurality of speakers are mounted on a projector for projecting an image and is adapted to transmit the sound wave toward a screen for displaying said projected image.

14. An audio output apparatus according to claim 1, wherein said plurality of speakers have an extremely narrow directionality.

15. An audio output apparatus according to claim 7, wherein said plurality of speakers have an extremely narrow directionality.

* * * * *

UNITED STATES PATENT AND TRADEMARK OFFICE

CERTIFICATE OF CORRECTION

PATENT NO. : 6,643,377 B1
DATED : November 4, 2003
INVENTOR(S) : Naoto Takahashi et al.

It is certified that error appears in the above-identified patent and that said Letters Patent is hereby corrected as shown below:

Column 1,
Line 10, “therefor.” should read -- therefor. ¶ Related Background Art --.

Column 8,
Lines 41and 51, “apparatus” should read -- system --.
Line 54, “apparatus” should read -- method --.

Signed and Sealed this

Tenth Day of August, 2004

JON W. DUDAS
*Acting Director of the United States Patent and Trademark Office*